United States Patent [19]

L'Heureux

[11] Patent Number: 4,774,646

[45] Date of Patent: Sep. 27, 1988

[54] MODULES FOR DECORATIVE LIGHTING

[76] Inventor: Raymond G. L'Heureux, 55 Copper Beech La., Levittown, Pa. 19055

[21] Appl. No.: 18,437

[22] Filed: Feb. 25, 1987

[51] Int. Cl.[4] ..... F21V 21/00

[52] U.S. Cl. ..... 362/249; 362/806; 362/145

[58] Field of Search ..... 362/249, 219, 227, 806, 362/145

[56] References Cited

U.S. PATENT DOCUMENTS

| | | | |
|---|---|---|---|
| 2,110,353 | 3/1938 | Barkes | 362/249 |
| 2,298,089 | 10/1942 | Veenboer | 362/249 |
| 3,204,090 | 8/1965 | Kvarda, Jr. | 362/249 |
| 3,384,227 | 5/1968 | Spatz | 362/249 |
| 3,692,993 | 9/1972 | Robinson | 362/249 |
| 3,894,225 | 7/1975 | Chao | 362/249 |
| 3,970,837 | 7/1976 | Helm | 362/249 |
| 4,128,863 | 12/1978 | Premetz | 362/249 |
| 4,244,014 | 1/1981 | Van Ess | 362/249 |
| 4,385,346 | 5/1983 | Spicer | 362/806 |
| 4,482,944 | 11/1984 | Roossine et al. | 362/806 |
| 4,542,446 | 9/1985 | Shiff et al. | 362/806 |
| 4,639,841 | 1/1987 | Salestrom | 362/227 |

*Primary Examiner*—E. Rollins Cross

*Attorney, Agent, or Firm*—Gilden & Israel

[57] ABSTRACT

Modules for decorative lighting are designed to replace conventional strings of Christmas lights. The modules include rigid strips of plastic, wood, or the like, with through-extending apertures in which conventional strings of lights can be positioned. Exterior surface portions of the strips are provided with attachment means, such as double faced tape, hook and loop fasteners, etc., with artificial plastic holly then being attached to the strip in a decorative manner. Through the use of hook and loop fasteners or similar attachment structure, the holly can be selectively rearranged when desired to form different decorative patterns.

1 Claim, 2 Drawing Sheets

FIG 3
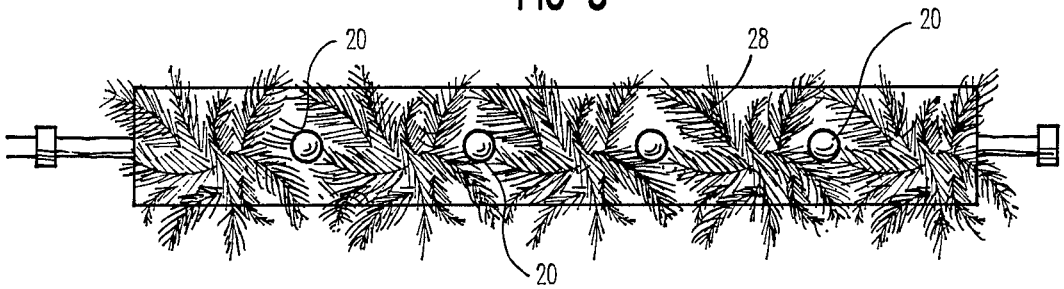
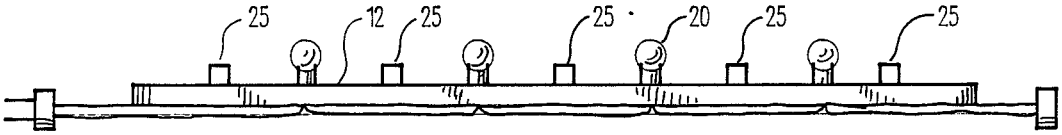
FIG 4
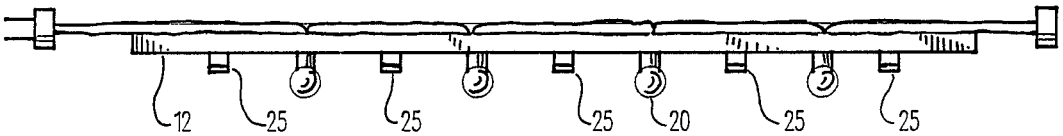
FIG 5
FIG 6
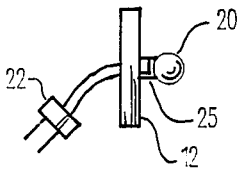
FIG 7
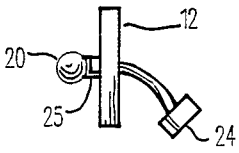

MODULES FOR DECORATIVE LIGHTING

BACKGROUND OF THE INVENTION

1. Field of the Invention

The present invention relates to lighting systems, and more particularly pertains to a new and decorative lighting system utilizable in conjunction with strings of Christmas lights.

2. Description of the Prior Art

The use of various module systems for providing decorative lighting is well known in the prior art. For example, reference is made to U.S. Pat. No. 3,692,993, which issued to S. Robinson on Sept. 19, 1972. The Robinson invention affectively comprises a lighting fixture unit which utilizes a housing adapted to be mounted on a building or some similar structure. Electric lights are carried in a holder which is swingably mounted within the housing to thus permit a moving of the lights between a hidden position in the housing and an exposed position extending through the housing. The system thus allows for the permanent mounting of Christmas lights to the eaves of a house whereby they are exposed and used only during the holiday season.

Another module system of interest is to be found in U.S. Pat. No. 4,128,863, which issued to M. Prematz on Dec. 5, 1978. As illustrated in this patent, a string of outdoor decorative lights may be connected to a facer board on a building cove. A stowable embodiment of the invention provides for a hinged attachment of the lights to the facer board and means for securing the lights in a displayed position or in a hidden position. This system is also designed for the permanent installation the lights around the eaves of the house.

A further lighting module system is shown in U.S. Pat. No. 4,357,653, which issued to M. Kovacs on Nov. 2, 1982. The Kovacs construction is defined by an adjustable four-sided frame assembled from four channel members. Each member is provided with slotted apertures for holding light bulbs on a longitudinal inner side flange thereof, and the frame structure is particularly designed for mounting around a rectangular window opening. The frame structure may be permanently mounted to the window edges, while the lights are selectively removable and attachable thereto, depending upon the season.

The above-described patents are illustrative of the fact that there is a continuing interest in new and improved lighting module systems utilizable in conjunction with the decorating of a home or some similar structure. While each of these systems are functional for their intended purpose, none of them address the need for additional and selectively changeable decorations which could be associated with the lights forming a part thereof. As can be appreciated, there is a continuing need for new and improved lighting module systems which facilitate creative decorative changes by users, and the present invention is substantially directed towards accommodating this need.

SUMMARY OF THE INVENTION

In view of the foregoing disadvantages inherent in the known types of decorative lighting modules now present in the prior art, the present invention provides an improved decorative lighting module wherein an exterior surface of an individual module is provided with a hook and loop fastening means, or the like, thus to facilitate the attachment of other decorative items around the light string forming a part of the module. As such, the general purpose of the present invention, which will be described subsequently in greater detail, is to provide a new and improved decorative lighting module system which has all the advantages of the prior art decorative lighting module systems and none of the disadvantages.

To attain this, the present invention essentially comprises the use of a plurality of rigid members having a plurality of through-extending apertures formed on axial lengths thereof. A conventional light string is attachable to each rigid member by a positioning of the light bulbs through the apertures, and the ends of the light string can be interconnected with similar light strings and module units to create a desired length of module lighting. An exterior surface of each rigid member is provided with a hook and loop fastening system, such as through the use of Velcro fasteners, or some similar adhesive means, whereby decorative plastic holly can be selectively attached to an exterior face of each rigid member when desired. Further, the holly can be arranged to accommodate the decorating desires of the user, while other decorative items of any design and shape could also be attached around the lights.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved decorative lighting module which has all the advantages of the prior art decorative lighting modules and none of the disadvantages.

It is another object of the present invention to provide a new and improved decorative lighting module which may be easily and efficiently manufactured and marketed.

It is a further object of the present invention to provide a new and improved decorative lighting module which is of a durable and reliable construction.

An even further object of the present invention is to provide a new and improved decorative lighting module which is susceptible of a low cost of manufacture with regard to both materials and labor, and which accordingly is then susceptible of low prices of sale to the consuming public, thereby making such decorative lighting modules economically available to the buying public.

Still yet another object of the present invention is to provide a new and improved decorative lighting module which provides in the apparatuses and methods of the prior art some of the advantages thereof, while simultaneously overcoming some of the disadvantages normally associated therewith.

Still another object of the present invention is to provide a new and improved decorative lighting module which provides for the rigid support of decorative lighting strings while also providing for the attachment of other decorative items around such lighting strings.

Yet another object of the present invention is to provide a new and improved decorative lighting module which is selectively attachable to a rigid structure and which accommodates the interconnection of a plurality of modules to create a lighting system of desired length.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevation view of the invention showing decorative plastic holly attached thereto.

FIG. 4 is a bottom plan view of the lighting module.

FIG. 5 is a top plan view of the module.

FIG. 6 is a left end elevation view of the invention.

FIG. 7 is a right end elevation view of the invention.

DESCRIPTION OF THE PREFERRED EMBODIMENT

Figure 1:
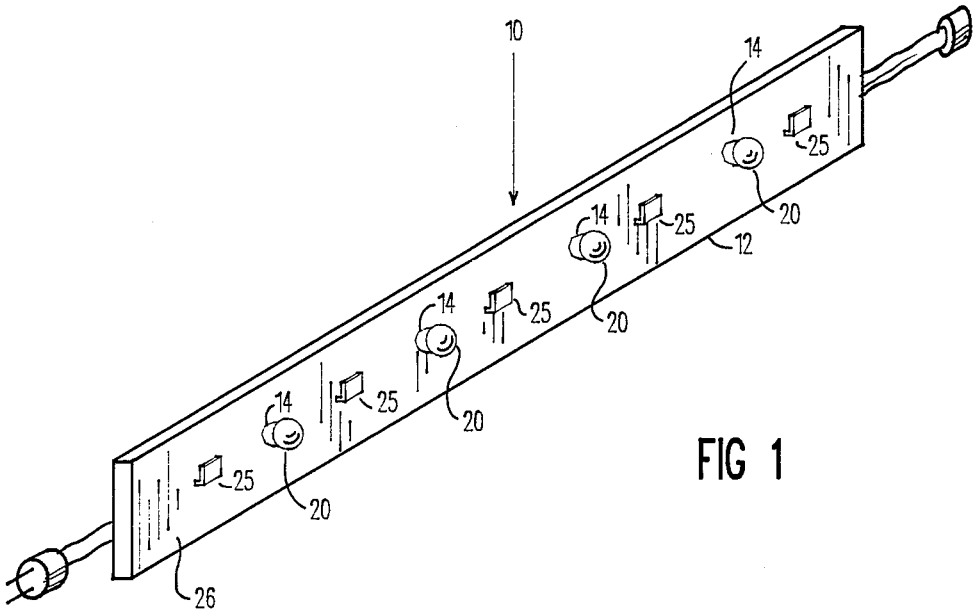
FIG. 1 is a perspective view of a decorative lighting module comprising the present invention.
Figure 2:
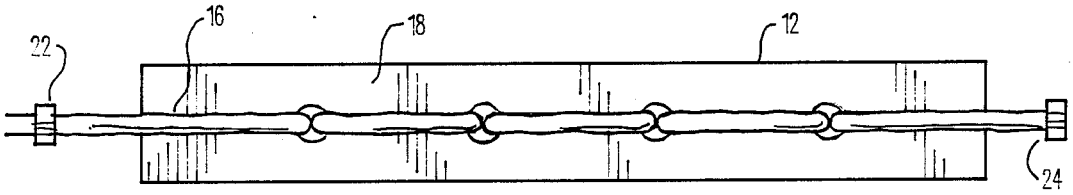
FIG. 2 is a rear elevation view of the invention.

With reference now to the drawings, and in particular to FIGS. 1–7 thereof, a new and improved decorative lighting module embodying the principles and concepts of the present invention and generally designated by the reference numeral 10 will be described.

More specifically, it will be noted that the decorative lighting module 10 essentially comprises a rigid support member 12, such as a plywood board, a section of rigid plastic, or the like, having a plurality of through-extending apertures 14 formed along an axial length thereof. A conventional string 16 of Christmas lights may be selectively mounted along a back surface 18 of the rigid member 12, with such string of lights having its bulbs 20 fixedly secured within each of the apertures 14. The Christmas light string 16 incudes a conventinoal male electrical connector 22 at one end thereof and a female electrical connector 24 attached to an opposed end thereof.

As best illustrated in FIG. 3 of the drawings, a front face 26 of the rigid member 12 can be covered with some conventional permanent adhesive means, such as strips of hook and loop fasteners. The hook and loop fasteners could comprise strips of Velcro, or some different attachment means could also be employed, e.g., double faced tape or the like. The hook and loop fastener construction would preferably comprise strips of conventional Velcro. A plurality of pieces 28 of plastic artificial holly, or the like, may also have strips of Velcro attached thereto so as to facilitate their selective positioning on and attachment to the front face 26 of the member 12. As such, a decorative pattern of holly 28 is positionable around the light bulbs 20. Of course, if a user so desires, the holly 28 could be permanently be affixed to the face 26 of the member 12, such as through the use of staples, glue, etc., with the entire module 10 then being removable and compactly storable when not being utilized.

With respect to the manner of usage and operation of the invention, the same should be apparent from the above description. In this regard, a plurality of lighting modules 10 can be mounted along the eaves of a house, or in some similar location, and the light strings 16 can then be electrically interconnected in a conventional manner so as to provide a decorative lighting structure during the holiday season.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A decorative lighting module assembly, comprising:

a. rigid support means;

b. light attachment means forming a part of said rigid support means, said light attachment means comprising at least one aperture formed in said rigid support means;

c. lighting means having at least one light bulb and associated socket, said socket being positionable within said aperture; and, d. decorative item attachment means forming a part of said rigid support means, said decorative attachment means being attached to an exposed face of said rigid support means, said decorative item attachment means facilitating an attachment of decorative items around said lighting means, said decorative items being provided with cooperating attachment means engageable with said attachment means forming a part of said exposed face of said rigid support means, whereby said decorative items may be selectively attached to and removed from said exposed face.

* * * * *